US006502926B2

(12) United States Patent
Cook et al.

(10) Patent No.: US 6,502,926 B2
(45) Date of Patent: Jan. 7, 2003

(54) INK JET SEMICONDUCTOR CHIP STRUCTURE

(75) Inventors: William Paul Cook, Lexington, KY (US); Stephen Francis DeFosse, Lexington, KY (US); Curtis Ray Droege, Richmond, KY (US); Hrishikesh Pramod Gogate, Lexington, KY (US); Eric Spencer Hall, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/772,721

(22) Filed: Jan. 30, 2001

(65) Prior Publication Data

US 2002/0101482 A1 Aug. 1, 2002

(51) Int. Cl.[7] ..... B41S 2/05
(52) U.S. Cl. ..... 347/63; 347/65
(58) Field of Search ..... 347/50, 58, 59, 347/63, 20, 65

(56) References Cited

U.S. PATENT DOCUMENTS

| | | | | |
|---|---|---|---|---|
| 4,496,793 A | | 1/1985 | Hanson et al. | |
| 4,680,859 A | * | 7/1987 | Johnson | 29/611 |
| 4,711,804 A | | 12/1987 | Burgess | |
| 4,763,188 A | | 8/1988 | Johnson | |
| 4,896,168 A | | 1/1990 | Newman et al. | |
| 4,942,408 A | * | 7/1990 | Braun | 347/63 |
| 5,292,688 A | | 3/1994 | Hsiao et al. | |
| 5,369,056 A | | 11/1994 | Burns et al. | |
| 5,473,513 A | | 12/1995 | Quinn | |
| 5,510,273 A | * | 4/1996 | Quinn | 437/7 |
| 5,528,457 A | | 6/1996 | Hawke et al. | |
| 5,538,586 A | * | 7/1996 | Swanson et al. | 156/307.6 |
| 5,545,473 A | | 8/1996 | Ameen et al. | |
| 5,581,121 A | | 12/1996 | Burns et al. | |
| 5,614,763 A | | 3/1997 | Womack | |
| 5,627,407 A | | 5/1997 | Suhir et al. | |
| 5,672,545 A | | 9/1997 | Trautt et al. | |
| 5,751,552 A | | 5/1998 | Scanlan et al. | |
| 5,778,523 A | | 7/1998 | Sylvester | |
| 5,834,848 A | | 11/1998 | Iwasaki | |
| 5,894,173 A | | 4/1999 | Jacobs et al. | |
| 5,895,971 A | | 4/1999 | Nakanishi | |
| 5,900,675 A | | 5/1999 | Appelt et al. | |
| 5,936,304 A | | 8/1999 | Lii et al. | |
| 5,952,719 A | | 9/1999 | Robinson et al. | |
| 5,960,260 A | | 9/1999 | Umehara et al. | |
| 6,014,317 A | | 1/2000 | Sylvester | |
| 6,046,496 A | | 4/2000 | Corisis et al. | |
| 6,049,124 A | | 4/2000 | Raiser et al. | |
| 6,071,427 A | * | 6/2000 | Raulinaitis | 216/27 |
| 6,186,622 B1 | | 2/2001 | Garcia et al. | |

FOREIGN PATENT DOCUMENTS

| | | |
|---|---|---|
| EP | 0 883 170 A1 | 12/1998 |
| JP | 2037752 | 2/1990 |
| JP | 3133193 | 6/1991 |
| JP | 10-181015 | 7/1998 |
| JP | 11-040687 | 2/1999 |

* cited by examiner

*Primary Examiner*—John Barlow
*Assistant Examiner*—Michael S Brooke
(74) *Attorney, Agent, or Firm*—David E. LaRose; Michael T. Sanderson; Jacqueline M. Daspit

(57) ABSTRACT

The invention provides a printhead for an ink jet printer and a method for making a printhead for an ink jet printer. The printhead includes a printhead body having a chip surface side, an ink surface side opposite the chip surface side and a first coefficient of thermal expansion (CTE). A semiconductor chip containing ink ejector devices is adhesively attached to the chip surface side of the printhead body. A stiffener is adhesively attached to the ink surface side to provide body stiffening during curing of the adhesive. The semiconductor chip has a second CTE and the stiffener has a third CTE wherein the second and third CTE's have a similar value. The invention provides an improved structure for printheads which resist warpage and/or breakage of the semiconductor chips during the manufacturing process used to make the printheads.

28 Claims, 4 Drawing Sheets

INK JET SEMICONDUCTOR CHIP STRUCTURE

FIELD OF THE INVENTION

The invention relates to ink jet printers, particularly to semiconductor chips used for ink ejection and to the structure and construction of the chips which provide reliable, long-life ink jet pens.

BACKGROUND

Ink jet printers continue to be improved as the technology for making the printheads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or printhead itself. This seemingly simple device is a microscopic marvel containing electrical circuits, ink passageways and a variety of tiny parts assembled with precision to provide a powerful, yet versatile ink jet pen. The printhead components of the pen must cooperate with each other and with an endless variety of ink formulations to provide the desired print properties. Accordingly, it is important to match the printhead components to the ink and the duty cycle demanded by the printer. Slight variations in production quality can have a tremendous influence on the product yield and resulting printer performance.

The primary components of the ink jet printhead are a semiconductor chip, a nozzle plate and a flexible circuit attached to the chip. The semiconductor chip is typically made of silicon and contains various passivation layers, conductive metal layers, resistive layers, insulative layers and protective layers deposited on a device surface thereof. For thermal ink jet printers, individual heater resistors are defined in the resistive layers and each heater resistor corresponds to a nozzle hole in the nozzle plate for heating and ejecting ink toward a print media. In a top-shooter type printhead, nozzle plates are attached to the chips and there are ink chambers and ink feed channels for directing ink to each of the ejection devices on the semiconductor chip either formed in the nozzle plate material or in a separate thick film layer. In a center feed design for a top-shooter type printhead, ink is supplied to the ink channels and ink chambers from a slot or single ink via which is conventionally formed by chemically etching or grit blasting through the thickness of the semiconductor chip. The chip, nozzle plate and flexible circuit assembly is typically bonded to a thermoplastic body using a heat curable and/or radiation curable adhesive to provide an ink jet pen.

Individual chips are fabricated from a silicon wafer containing many chips. The chips are cut from the wafer during the pen fabrication process and are attached to the pen body. Chips typically measure 2 to 8 mm wide by 10 to 20 mm long by 0.6 to 0.65 mm thick. The chips are delicate and require special care to prevent cracking, breaking or warping during the assembly process.

In order to increase print speed, larger chips are being designed. By increasing the size of the chips, the chips are capable of containing more ink ejectors thereby providing more ink per print swath. However, larger chips also increase the difficulty associated with handling the chips without damage or breakage and larger chips require more care when attaching the chips to a thermoplastic body so as to minimize chip cracking and warpage.

As advances are made in print quality and speed, a need arises for an increased number of ink ejectors which are more closely spaced on the silicon chips. The advances in print speed and quality encourage increases in printhead complexity resulting in a need for long-life printheads which can be produced in high yield while meeting more demanding manufacturing tolerances. Thus, there continues to be a need for improved manufacturing processes and techniques which provide improved printhead components.

SUMMARY OF THE INVENTION

With regard to the foregoing, the invention provides an improved ink jet printhead and method for making a printhead for an ink jet pen. The printhead includes a printhead body having a chip surface side, an ink surface side opposite the chip surface side and a first coefficient of thermal expansion (CTE). A semiconductor chip containing ink ejector devices is adhesively attached to the chip surface side of the printhead body. A stiffener is adhesively attached to the ink surface side to provide body stiffening during curing of the adhesive. The semiconductor chip has a second CTE and the stiffener has a third CTE wherein the second and third CTE's have a similar value.

In another aspect, the invention provides a method for making a printhead for an ink jet printer. The method includes the steps of providing a printhead body having a chip surface side, an ink surface side opposite the chip surface side and a first coefficient of thermal expansion (CTE). An adhesive is applied to the chip surface side of the printhead body. A semiconductor chip containing ink ejector devices and having a second CTE is adhesively attached to the chip surface side of the printhead body using the adhesive. A stiffener having a third CTE is adhesively attached to the ink surface side of the printhead body using the adhesive to provide body stiffening during curing of the adhesive and the adhesive is cured. The second and third CTE's preferably have a similar value.

In yet another aspect the invention provides an ink jet pen for an ink jet printer. The pen includes an ink container, ink in the ink container and a printhead body attached to the ink container having a chip surface side, an ink surface side opposite the chip surface side and a first coefficient of thermal expansion (CTE). A semiconductor chip containing ink ejector devices and having a second CTE is adhesively attached to the chip surface side of the printhead body. A stiffener having a third CTE is adhesively attached to the ink surface side to provide body stiffening during curing of the adhesive, wherein the second and third CTE's have a similar value.

An advantage of the invention is that it provides an improved structure for printheads which resist warpage and/or breakage of the semiconductor chips during the manufacturing process used to make the printheads. It has been observed that the chip side of the printhead body is substantially constrained from contracting by the chip and adhesive during the cooling process after curing the chip adhesive, while the unconstrained side of the printhead body is free to expand and contract. This unequal constraint on the printhead body material induces bowing of the printhead body during the curing process sufficient to warp or crack the chip. The invention solves the bowing problem by providing a stiffener on the opposite side of the printhead body from the chip. It is preferred that the stiffener be attached to the printhead body with the same adhesive used to attach the chip and that the stiffener be placed substantially opposite the chip on the opposing surface of the printhead body. Another advantage of the invention is that the printheads exhibit improved impact resistance due to the presence of the stiffener thereby improving product yield and decreasing chip failure during printhead handling in manufacturing or by consumers.

BRIEF DESCRIPTION OF THE DRAWINGS

Further features and advantages of the invention will become apparent by reference to the detailed description when considered in conjunction with the FIGS., which are not to scale, wherein like reference numbers indicate like elements through the several views, and wherein.

DETAILED DESCRIPTION OF THE INVENTION

Figure 1:
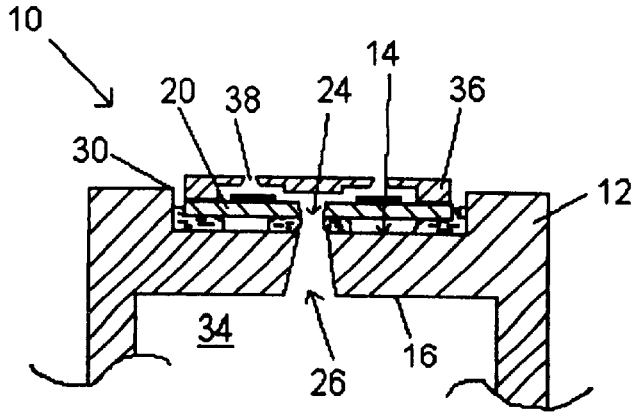
FIG. 1 is an end cross-sectional view through a portion of an ink jet printhead including a printhead body and semiconductor chip.
Figure 1A:
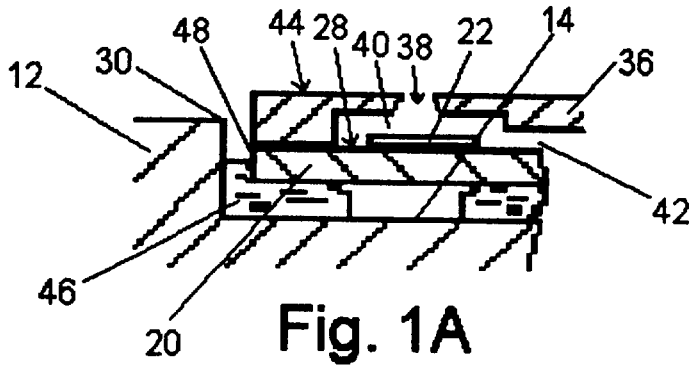
FIG. 1A is an enlarged cross-sectional view of a portion of an ink jet printhead including a printhead body and a semiconductor chip.

With reference to FIGS. 1 and 1A, there is shown a portion of an ink jet 10 printhead 10 viewed in cross-section from a narrow end thereof. The printhead 10 includes a printhead body 12 having a chip surface 14 and an ink surface 16 opposite the chip surface 14. The printhead body 12 is preferably made of a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene ether/polystyrene alloy resin available from G.E. Plastics under the trade names NORYL SE1 and NORYL 300X and polyamide/polyphenylene ether alloy resin available from G.E. Plastics under the trade name NORYL GTX. A preferred material for making the printhead body is ULTEM 1010 polymer. A printhead body made of ULTEM 1010 polymer has a coefficient of thermal expansion (CTE) of about 42 microns/meter per ° C. as determined by ASTM E-831.

In order to eject ink from an ink jet pen 18 (FIG. 2), the pen 18 contains one or more of the ink jet printheads 10. The one or more printheads 10 each include a semiconductor substrate 20, preferably a silicon semiconductor substrate 20 having a CTE of about 2 to about 3 microns/meter per ° C. as determined by ASTM C-372. The semiconductor substrate 20 contains a plurality of heater resistors 22 thereon (FIG. 1A) for heating ink supplied through an ink via 24 in the semiconductor chip 20 and an ink feed slot 26 in the printhead body 12. The ink via 24 may be provided conventionally, as by grit blasting through the silicon substrate. The heater resistors 22 are formed in the device side 28 of the chip 20 by well known semiconductor manufacturing techniques. The printhead body 12 preferably includes a recess or chip pocket 30 therein for attachment of a semiconductor chip 20 to body 12.

The semiconductor chips 20 are relatively small in size and typically have overall dimensions ranging from about 2 to about 8 millimeters wide by about 10 to about 20 millimeters long and from about 0.6 to about 0.65 mm thick. In conventional semiconductor chips 20 containing slot-type ink vias 24 which are grit blasted in the chips 20, the ink via slots 24 have dimensions of about 9.7 millimeters long and 0.39 millimeters wide. In the alternative, the ink via 24 may be provided by a slot or a plurality of holes adjacent the heater resistors 22 made by a deep reactive ion or inductively coupled plasma process.

Figure 2:
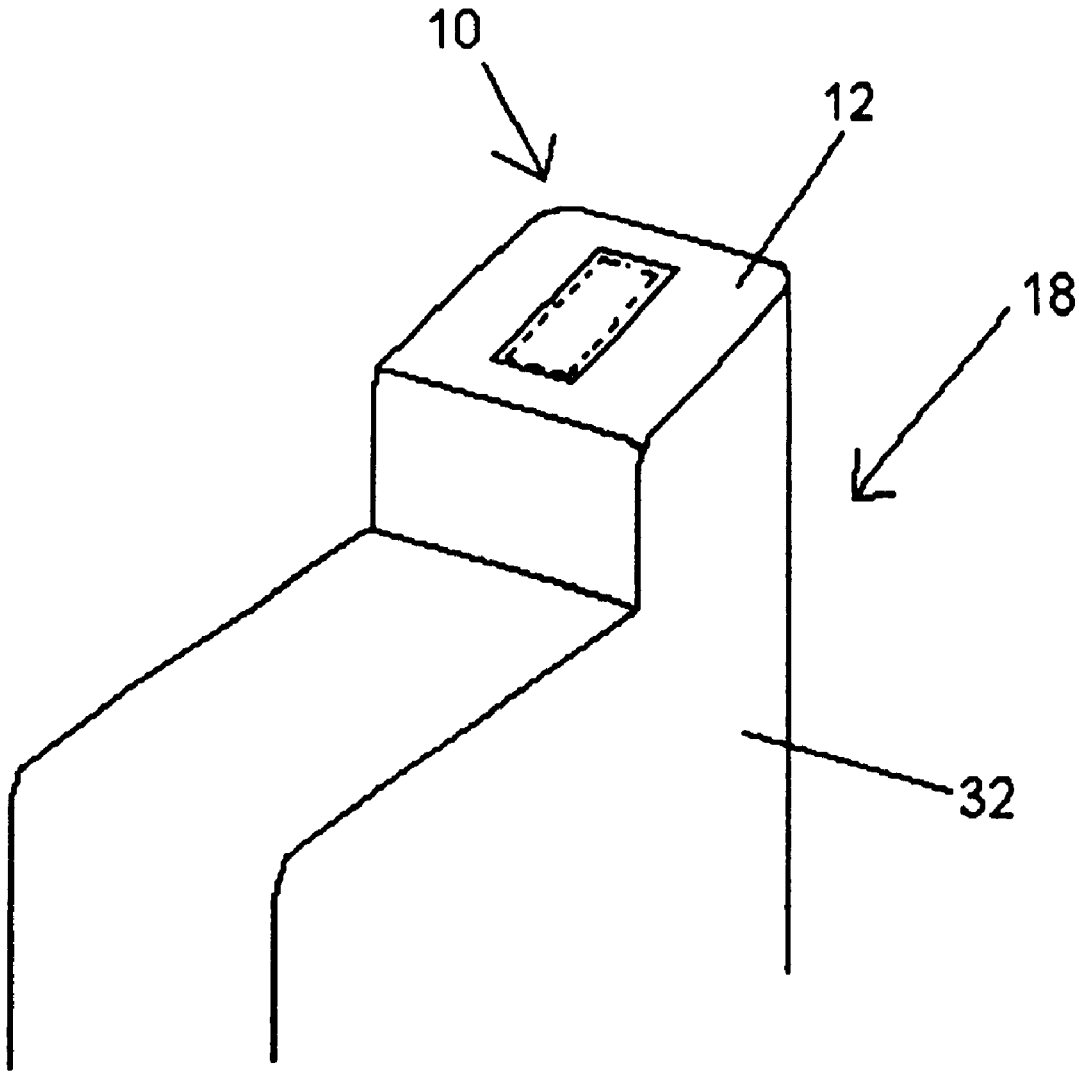
FIG. 2 is a perspective view of an ink jet pen according to the invention.

The ink feed vias 24 are etched through the entire thickness of the semiconductor chip 20 and are in fluid communication with ink supplied from an ink supply container 32, ink cartridge or remote ink supply. In FIGS. 1 and 2, the ink supply container 32 is integral with the printhead body 12, however the invention is not limited to such an ink supply arrangement. The ink vias 24 direct ink from an ink supply area 34 which is located adjacent the ink surface 16 of the printhead body 12 through the chip 20 to the device side 28 of the chip 20 containing heater resistors 22 (FIG. 1A). The device side 28 of the chip also preferably contains electrical tracing from the heater resistors to contact pads used for connecting the chip 20 to a flexible circuit or TAB circuit for supplying electrical impulses from a printer controller to activate one or more heater resistors 22.

Prior to attaching the chip to the printhead body 12, a nozzle plate 36 is attached to the device side 28 of the chip 20 by use of one or more adhesives such as a UV-curable or heat curable epoxy adhesive. The adhesive used to attach the nozzle plate 36 to the chip 20 is preferably a heat curable adhesive such as a B-stageable thermal cure resin, including, but not limited to phenolic resins, resorcinol resins, epoxy resins, ethylene-urea resins, furane resins, polyurethane resins and silicone resins. A particularly preferred adhesive for attaching the nozzle plate 36 to the chip is a phenolic butyral adhesive which is cured by heat and pressure. The nozzle plate adhesive is preferably cured before attaching the chip 20 to the printhead body 12.

As shown in detail in FIG. 1A, the nozzle plate 36 contains a plurality of nozzle holes 38 each of which are in fluid flow communication with an ink chamber 40 and an ink supply channel 42 which are formed in the nozzle plate material by means such as laser ablation. A preferred nozzle plate material is polyimide which may contain an ink repellent coating on a surface 44 thereof.

The nozzle plate 36 and semiconductor chip 20 are preferably aligned optically so that the nozzle holes 38 in the nozzle plate 36 align with heater resistors 22 on the semiconductor chip 20. Misalignment between the nozzle holes 38 and the heater resistor 22 may cause problems such as misdirection of ink droplets from the printhead 10, inadequate droplet volume or insufficient droplet velocity.

After attaching the nozzle plate 36 to the chip 20, the semiconductor chip 20 of the nozzle plate/chip assembly 36/20 is electrically connected to the flexible circuit or TAB circuit and the nozzle plate/chip assembly 36/20 is attached to the printhead body 12 using a die bond adhesive 46. The nozzle plate/chip assembly 36/20 is preferably attached to the printhead body 12 in the chip pocket 30. The die bond adhesive 46 seals around edges 48 of the semiconductor chip 20 to provide a substantially liquid tight seal to inhibit ink from flowing between edges 48 of the chip 10 and the chip pocket 30.

The die bond adhesive 46 used to attach the nozzle plate/chip assembly 36/20 to the printhead body 12 is preferably an epoxy adhesive such as a die bond adhesive available from Emerson & Cuming of Monroe Township, N.J. under the trade name ECCOBOND 3193-17. In the case of a thermally conductive printhead body 12, the die bond adhesive 46 is preferably a resin filled with thermal conductivity enhancers such as silver or boron nitride. A preferred thermally conductive die bond adhesive 46 is POLY-SOLDER LT available from Alpha Metals of Cranston, R.I. A suitable die bond adhesive 46 containing boron nitride fillers is available from Bryte Technologies of San Jose, Calif. under the trade designation G0063. The thickness of adhesive 46 preferably ranges from about 25 microns to about 125 microns. Heat is typically required to cure adhesive 46 and fixedly attach the nozzle plate/chip assembly 36/20 to the printhead body 12.

Once the nozzle plate/chip assembly 36/20 is attached to the printhead body 12, the flexible circuit or TAB circuit is attached to the printhead body 12 by use of a heat activated or pressure sensitive adhesive. Preferred pressure sensitive adhesives include, but are not limited to phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn. The pressure sensitive adhesive preferably has a thickness ranging from about 25 to about 200 microns.

Ejection of ink through the nozzle holes 38 is controlled by a print controller in the printer to which the printhead 10 is attached. Connections between the print controller and the heater resistors 22 of printhead 10 are provided by electrical traces which terminate in contact pads on the device side 28 of the chip 20. Electrical TAB bond or wire bond connections are made between the flexible circuit or TAB circuit and the contact pads on the semiconductor chip 20.

During a printing operation, an electrical impulse is provided from the printer controller to activate one or more of the heater resistors 22 thereby heating ink in the ink chamber 40 to vaporize a component of the ink thereby forcing ink through nozzle hole 38 toward a print media. Ink is caused to refill the ink channel 42 and ink chamber 40 by collapse of the bubble in the ink chamber once ink has been expelled through nozzle 38. The ink flows from the ink supply area 34 (FIG. 1) through an ink feed slot 26 in the printhead body 12 to the ink feed vias 24 in the chip 20.

Figure 3:
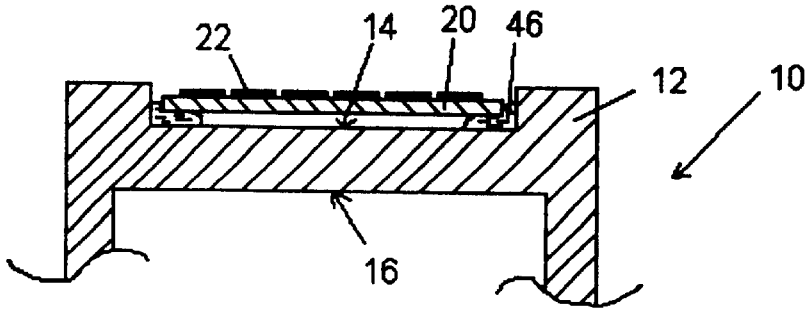
FIG. 3 is a side cross-sectional view through a portion of a printhead body and semiconductor chip.

One step in the manufacture of an ink jet pen is the curing of the adhesives used to attach the nozzle plate 36 to the chip 20 and to attach the nozzle plate/chip assembly 36/20 to the printhead body 12. During the curing step, the printhead body 12 and chip 20 are heated to a temperature ranging from about 80° to about 120° C. or higher. The expansion of the nozzle plate/chip assembly 36/20 is shown schematically in cross-sectional side views in FIGS. 3–7. For simplicity and clarity, only the chip 20 and printhead body 12 are shown. Furthermore, it will be recognized that expansion of the printhead body 12 and chip 20 occur in all directions upon heating during the curing step. In FIG. 3, the chip 20 and printhead body 12 are at room temperature after placing the nozzle plate/chip assembly 36/20 in the chip pocket 30 (FIG. 1). The die bond adhesive 46 is disposed on the chip 20 or in the chip pocket 30 to fixedly attach the chip 20 to the printhead body 12. The printhead body 12 thickness to which the chip 20 is attached preferably ranges from about 0.5 to about 3 mm.

Figure 4:
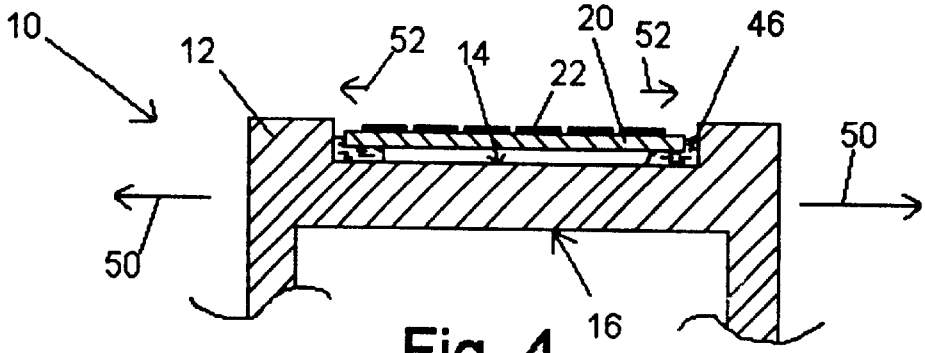
FIG. 4 is a diagrammatic representation of expansion of a printhead body and semiconductor chip as an adhesive between the body and chip is being cured.

In FIG. 4, the chip 20 and printhead 12 are heated to the curing temperature as described above. As the chip 20 and printhead 12 are heated, the chip 20, printhead 12 and adhesive 46 expand proportional to their respective CTE's. For example, a printhead body made of ULTEM 1010 polymer having a CTE of about 42 microns/meter per ° C. may increase as much as 53.3 microns in length for a printhead body length of about 12 to about 13 millimeters at a temperature of 100° C. as indicated diagrammatically by long arrows 50. In contrast a silicon chip 20 having a CTE of about 2.6 microns/meter per ° C. may increase in length only 3.2 microns at 100° C. as indicated diagrammatically by relatively short arrows 52. The adhesive 46 having a CTE of about 114 microns/meter per ° C. may increase as much as 145 microns in length.

Figure 5:
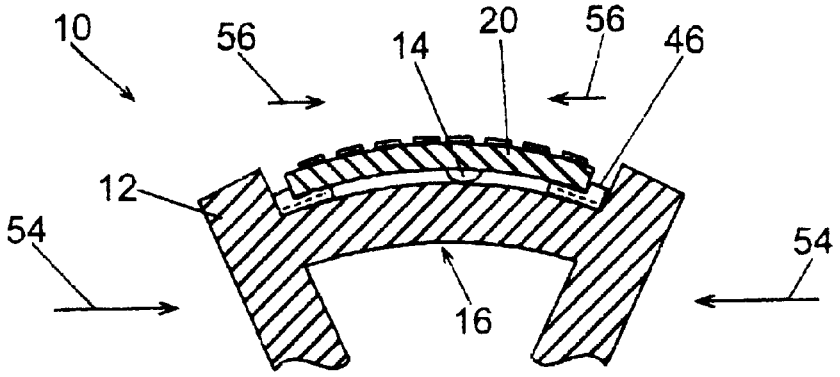
FIG. 5 is a diagrammatic representation of bowing of a printhead body and semiconductor chip during a cooling process after curing an adhesive used to attached the chip to the body.

Upon cooling after curing adhesive 46, the ink surface 16 of the printhead body 12 contracts substantially more than the chip surface 14 which is substantially constrained by the chip 20 and cured adhesive 46. Because of the relatively large difference in the CTE's of the chip 20 and printhead body 12, the ink surface 16 of the printhead body 12 will tend to contract to a greater degree as represented diagrammatically by arrows 54 than the contraction of the chip 20 represented diagrammatically by arrows 56. Unequal contraction of the printhead 10 upon cooling induces bowing of the printhead 10 as shown in diagrammatic representation in FIG. 5. It will be recognized that the bowing of the printhead 10 may not be as dramatic as shown in FIG. 5, however it may be sufficient to substantially bow or crack the chip 20 resulting in pen failure or production loss of useable parts. For example, a chip 20 having a length of about 16 millimeters had a bow height of about 32 microns above the plane of the chip 20 in the center of the chip 20 upon cooling the chip 20 and printhead body 12 after curing the die bond adhesive 46.

The invention provides a novel solution to the problem associated with printhead bowing and chip cracking described above. According to the invention, a stiffener 58 is attached to the ink surface 16 of the printhead body 12. The stiffener 58 preferably has a CTE similar to the CTE of the chip 20 and the stiffener 58 is preferably attached to surface 16 of the printhead body 16 using an adhesive 60 similar to adhesive 46. The stiffener 58 may be selected from the group consisting of aluminum oxide and various glasses and ceramic materials having a CTE similar to the CTE of the silicon substrate 20. In a particularly preferred embodiment, the stiffener 58 is made of silicon or is a silicon chip having similar dimensions to the semiconductor chip 20. The dimensions of the stiffener preferably range from about 2 to about 8 mm wide, from about 10 to about 20 mm long and from about 0.6 to about 0.65 mm thick. It is also preferred, though not required that adhesive 60 and adhesive 46 be the same or at least have similar CTE's.

Figure 6:
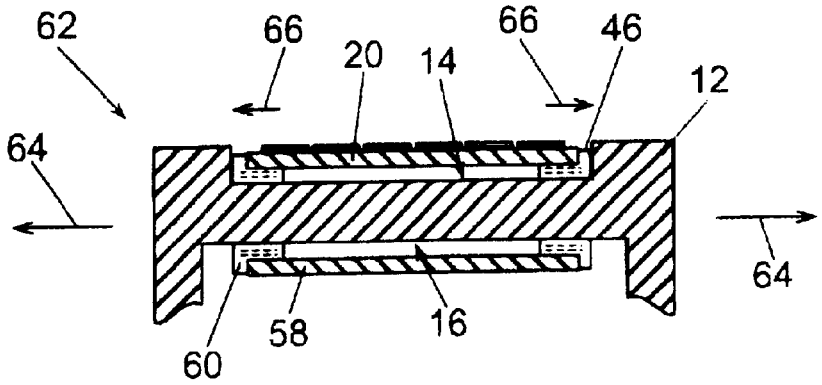
FIG. 6 is a side cross-sectional view through a portion of a printhead body, semiconductor chip and stiffener during a heating step for curing an adhesive for the printhead according to the invention.
Figure 7:
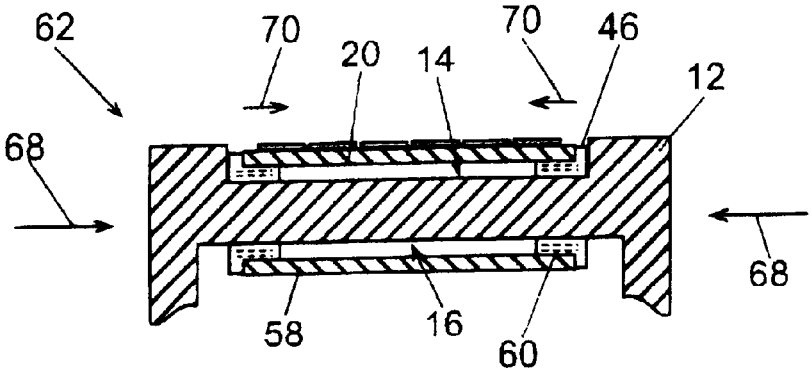
FIG. 7 is a side-cross-sectional view through a portion of a printhead body, semiconductor chip and stiffener during a cooling step after curing an adhesive used to attach a chip and stiffener to a printhead body according to the invention.

The stiffener 58 is preferably positioned substantially opposite the semiconductor chip 20 so that upon heating and cooling of a printhead 62 as shown diagrammatically in FIGS. 6 and 7, both surfaces 14 and 16 of the printhead body 12 are equally constrained. The heating step is indicated diagrammatically in FIG. 6 by long and short arrows 64 and 66 respectively and the cooling step is indicated diagrammatically in FIG. 7 by long and short arrows 68 and 70 respectively. The bow height in the center of a chip 20 of a printhead 62 according to the invention is less than about 2 microns for a 16 millimeter long chip 20. The dramatic decrease in bowing of the printhead body 12 and chip 20 compared to conventional printheads as a result of the use of stiffener 58 is significant and provides improved fabrication techniques for printheads 10 which result in higher production yields and longer ink jet pen life. Because there is less bowing of the chip 20, ink droplet placement from ink ejected from the printheads 10 tends to be more accurate resulting in higher quality printing.

The stiffener 58 may be attached to the printhead body 12 before or after attaching the chip 20 to the printhead body. In one process, the stiffener 58 is attached with an adhesive 60 to ink surface 16 of the printhead body 12. Adhesive 60 is then cured using heat. The assembly is cleaned to assure that no debris or excessive adhesive is present on the chip surface 14 or in the ink feed slot 26. A filter, if any, is next attached to the ink surface side 16 of the printhead body 12 to provide filtered ink through the stiffener 58 and ink feed slot 26 to the chip 20. Next the nozzle plate/chip assembly 36/20 is attached with adhesive 46 to the chip surface 14 of the printhead body 12. Adhesive 46 is then cured.

Figure 8:
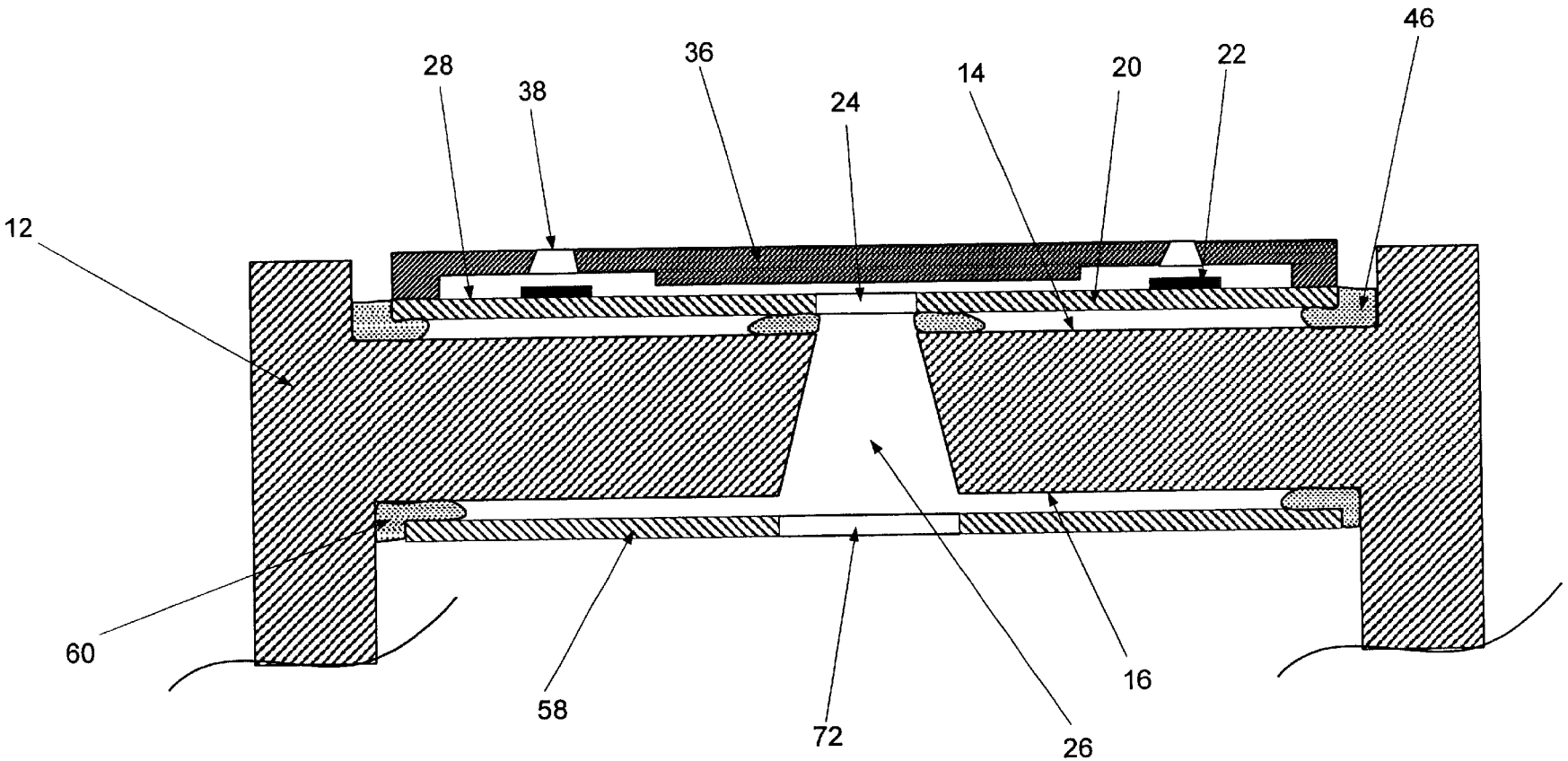
FIG. 8 is an end cross-sectional view through a portion of an ink jet printhead including a printhead body, semiconductor chip and stiffener assembly according to the invention.

It will be recognized that the stiffener 58 and chip 20 may be attached to the printhead body 12 before curing either adhesive 60 or adhesive 46. In this case, both adhesives 46 and 60 are cured at essentially the same time. Regardless of the process sequence selected, the stiffener 58 is effective to prevent excessive bowing or warping of the chip during the adhesive 46 curing process. As with the semiconductor chip 20, the stiffener 58 also contains an ink via 72 as shown in FIG. 8 for flow of ink therethrough to the heater resistors 22 on the device side 28 of the chip 20.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A printhead for an ink jet printer, comprising: a printhead body having a first coefficient of thermal expansion (CTE), a chip surface side, an ink surface side opposite the chip surface side and an ink feed slot; a semiconductor chip containing ink ejector devices and a first ink via therein, the chip being adhesively secured to the chip surface side of the printhead body; and a stiffener adhesively secured to the ink surface side to provide body stiffening during curing of the adhesive, the semiconductor chip having a second CTE and the stiffener having a third CTE wherein the second and third CTE's have a similar value and wherein the stiffener includes a second ink via therein.

2. The printhead of claim 1 wherein the CTE of the printhead body is substantially greater than the second and third CTE's.

3. The printhead of claim 1 wherein the adhesive comprises an epoxy adhesive.

4. The printhead of claim 1 wherein the stiffener is positioned on the ink surface side of the printhead body substantially opposite the semiconductor chip on the chip surface side of the printhead body.

5. The printhead of claim 1 wherein the printhead body between the chip surface side and the ink surface side has a thickness ranging from about 0.5 to about 3 mm.

6. The printhead of claim 1 wherein the printhead body comprises a material selected from the group consisting of an amorphous thermoplastic polyetherimide, glass filled thermoplastic polyethylene terephthalate resin, syndiotactic polystyrene resin containing glass fiber, polyphenylene ether/polystyrene alloy resin and polyamide/polyphenylene ether alloy resin.

7. The printhead of claim 1 wherein the stiffener comprises a silicon chip.

8. The printhead of claim 1 wherein the stiffener comprises aluminum oxide.

9. A method for making a printhead for an ink jet printer, comprising the steps of: providing a printhead body having a first coefficient of thermal expansion (CTE), a chip surface side, an ink surface side opposite the chip surface side and an ink feed slot; applying an adhesive to the chip surface side of the printhead body; adhesively attaching a semiconductor chip having a second CTE and containing ink ejector devices and a first ink via therein to the chip surface side of the printhead body using the adhesive; providing a stiffener having a third CTE and a second ink via therein; applying the adhesive to the ink surface side of the printhead body; adhesively attaching the stiffener to the ink surface side to provide body stiffening during curing of the adhesive; and curing the adhesive to provide an inkjet printhead, wherein the second and third CTE's have a similar value.

10. The method of claim 9 wherein the printhead body is provided having a substantially greater CTE than the second and third CTE's.

11. The method of claim 9 wherein an epoxy adhesive is applied to the chip surface side of the printhead body.

12. The method of claim 9 wherein the stiffener is positioned and attached to the ink surface side of the printhead body substantially opposite the semiconductor chip on the chip surface side of the printhead body.

13. The method of claim 9 wherein the printhead body comprises a material selected from the group consisting of an amorphous thermoplastic polyetherimide, glass filled thermoplastic polyethylene terephthalate resin, syndiotactic polystyrene resin containing glass fiber, polyphenylene ether/polystyrene alloy resin and polyamide/polyphenylene ether alloy resin.

14. The method of claim 9 wherein the stiffener comprises a silicon chip.

15. The method of claim 9 wherein the stiffener comprises aluminum oxide.

16. A method for reducing breakage and warpage of semiconductor chips for ink jet printheads, the method comprising attaching a stiffener to a polymeric printhead body on an ink surface side of the printhead body using a first adhesive, curing the first adhesive, attaching a semiconductor chip having a first coefficient of thermal expansion (CTE) and containing a first ink via therein to the printhead body on a chip surface side of the printhead body opposite the ink surface side of the printhead body using a second adhesive, the printhead body having a CTE substantially higher than the CTE of the semiconductor chip, and the stiffener having a second CTE substantially similar to the first CTE, wherein the stiffener includes a second ink via therein.

17. The method of claim 16 wherein the first and second adhesives comprise epoxy adhesives.

18. The method of claim 16 wherein the stiffener is positioned on the printhead body substantially opposed to the semiconductor chip on the opposite side of the printhead body.

19. The method of claim 16 wherein the stiffener comprises a silicon chip.

20. The method of claim 16 wherein the stiffener comprises aluminum oxide.

21. An ink jet pen for an ink jet printer comprising: an ink container; ink in the ink container; and a printhead body attached to the ink container having a chip surface side, the printhead body having a first coefficient of thermal expansion (CTE), an ink surface side opposite the chip surface side and an ink feed slot therein, a semiconductor chip having a second CTE adhesively attached to the chip surface side of the printhead body, the semiconductor chip containing ink ejector devices and a first ink via therein and a stiffener having a third CTE adhesively attached to the ink surface side to provide body stiffening during curing of the adhesive, wherein the second and third CTE's have a similar value and wherein the stiffener includes a second ink via therein.

22. The ink jet pen of claim 21 wherein the CTE of the printhead body is substantially greater than the second and third CTE's.

23. The ink jet pen of claim 21 wherein the adhesive comprises an epoxy adhesive.

24. The ink jet pen of claim 21 wherein the stiffener is positioned on the ink surface side of the printhead body substantially opposite the semiconductor chip on the chip surface side of the printhead body.

25. The ink jet pen of claim 21 wherein the printhead body between the chip surface side and the ink surface side has a thickness ranging from about 0.5 to about 3 mm.

26. The ink jet pen of claim 21 wherein the printhead body comprises a material selected from the group consisting of an amorphous thermoplastic polyetherimide, glass filled thermoplastic polyethylene terephthalate resin, syndiotactic polystyrene resin containing glass fiber, polyphenylene ether/polystyrene alloy resin and polyamide/polyphenylene ether alloy resin.

27. The ink jet pen of claim 21 wherein the stiffener comprises a silicon chip.

28. The ink jet pen of claim 21 wherein the stiffener comprises aluminum oxide.

* * * * *